US006454382B1

(12) United States Patent
Galentovski

(10) Patent No.: US 6,454,382 B1
(45) Date of Patent: Sep. 24, 2002

(54) MALFUNCTIONING NOZZLE DETECTION APPARATUS

(76) Inventor: Vladimir Galentovski, 2770 Aquitaine Avenue STE 801, Mississauga, Ontario (CA), L5N 3K5

( * ) Notice: Subject to any disclaimer, the term of this patent is extended or adjusted under 35 U.S.C. 154(b) by 36 days.

(21) Appl. No.: 09/853,516

(22) Filed: May 11, 2001

(51) Int. Cl.[7] ..... B41J 29/393; B41J 29/38
(52) U.S. Cl. ..... 347/19; 347/14
(58) Field of Search ..... 347/19, 3–5, 14, 347/23, 15, 43, 104; 101/465

(56) References Cited

U.S. PATENT DOCUMENTS 4,125,845 A 11/1978 Stevenson
4,158,204 A 6/1979 Kuhn et al.
4,907,013 A 3/1990 Hubbard et al.
D359,923 S 7/1995 Sandell
5,448,269 A * 9/1995 Beauchamp et al. ..... 347/19
5,748,204 A * 5/1998 Harrison ..... 347/2
5,963,225 A 10/1999 Sugiyama
6,039,429 A 3/2000 Balousek
6,074,054 A * 6/2000 Katsuyama ..... 347/104
6,321,652 B1 * 11/2000 Fujinami et al. ..... 101/465

* cited by examiner

*Primary Examiner*—John Barlow
*Assistant Examiner*—Charles W. Stewart, Jr.

(57) ABSTRACT

A malfunctioning nozzle detection apparatus for detecting malfunctioning inkjet nozzles of an inkjet printer eliminating the need for a human operator to identify the malfunctioning nozzles. The malfunctioning nozzle detection apparatus includes a testing media assembly that is adapted for coupling within the printer. The testing media assembly is adapted for having a carriage of the printer positioned over the testing media assembly such that the nozzles can print a test image on the testing media assembly. A scanning assembly is adapted for coupling within the printer proximate the testing media assembly. The scanning assembly is for optically scanning the test image printed on the testing media assembly. The scanning assembly is adapted for operationally coupling to a controller of the printer such that that the controller adjusts the print head when the scanning assembly detects imperfections in the test image.

11 Claims, 5 Drawing Sheets

MALFUNCTIONING NOZZLE DETECTION APPARATUS

BACKGROUND OF THE INVENTION

1. Field of the Invention

The present invention relates to malfunctioning nozzle apparatuses and more particularly pertains to a new malfunctioning nozzle detection apparatus for detecting malfunctioning inkjet nozzles of an inkjet printer eliminating the need for a human operator to identify the malfunctioning nozzles.

2. Description of the Prior Art

The use of malfunctioning nozzle apparatuses is known in the prior art. More specifically, malfunctioning nozzle apparatuses heretofore devised and utilized are known to consist basically of familiar, expected and obvious structural configurations, notwithstanding the myriad of designs encompassed by the crowded prior art, which have been developed for the fulfillment of countless objectives and requirements.

Known prior art includes U.S. Pat. Nos. 4,907,013; 5,963,225; 4,125,845; 4,158,204; 6,039,429; and Des. 359,923.

While these devices fulfill their respective, particular objectives and requirements, the aforementioned patents do not disclose a new malfunctioning nozzle detection apparatus. The inventive device includes a testing media assembly that is adapted for coupling within the printer. The testing media assembly is adapted for having a carriage of the printer positioned over the testing media assembly such that the nozzles can print a test image on the testing media assembly. A scanning assembly is adapted for coupling within the printer proximate the testing media assembly. The scanning assembly is for optically scanning the test image printed on the testing media assembly. The scanning assembly is adapted for operationally coupling to a controller of the printer such that that the controller adjusts the print head when the scanning assembly detects imperfections in the test image.

In these respects, the malfunctioning nozzle detection apparatus according to the present invention substantially departs from the conventional concepts and designs of the prior art, and in so doing provides an apparatus primarily developed for the purpose of detecting malfunctioning inkjet nozzles of an inkjet printer eliminating the need for a human operator to identify the malfunctioning nozzles.

SUMMARY OF THE INVENTION

In view of the foregoing disadvantages inherent in the known types of malfunctioning nozzle apparatuses now present in the prior art, the present invention provides a new malfunctioning nozzle detection apparatus construction wherein the same can be utilized for detecting malfunctioning inkjet nozzles of an inkjet printer eliminating the need for a human operator to identify the malfunctioning nozzles.

The general purpose of the present invention, which will be described subsequently in greater detail, is to provide a new malfunctioning nozzle detection apparatus apparatus and method which has many of the advantages of the malfunctioning nozzle apparatuses mentioned heretofore and many novel features that result in a new malfunctioning nozzle detection apparatus which is not anticipated, rendered obvious, suggested, or even implied by any of the prior art malfunctioning nozzle apparatuses, either alone or in any combination thereof.

To attain this, the present invention generally comprises a testing media assembly that is adapted for coupling within the printer. The testing media assembly is adapted for having a carriage of the printer positioned over the testing media assembly such that the nozzles can print a test image on the testing media assembly. A scanning assembly is adapted for coupling within the printer proximate the testing media assembly. The scanning assembly is for optically scanning the test image printed on the testing media assembly. The scanning assembly is adapted for operationally coupling to a controller of the printer such that that the controller adjusts the print head when the scanning assembly detects imperfections in the test image.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new malfunctioning nozzle detection apparatus apparatus and method which has many of the advantages of the malfunctioning nozzle apparatuses mentioned heretofore and many novel features that result in a new malfunctioning nozzle detection apparatus which is not anticipated, rendered obvious, suggested, or even implied by any of the prior art malfunctioning nozzle apparatuses, either alone or in any combination thereof.

It is another object of the present invention to provide a new malfunctioning nozzle detection apparatus, which may be easily and efficiently manufactured and marketed.

It is a further object of the present invention to provide a new malfunctioning nozzle detection apparatus, which is of a durable and reliable construction.

An even further object of the present invention is to provide a new malfunctioning nozzle detection apparatus which is susceptible of a low cost of manufacture with regard to both materials and labor, and which accordingly is then susceptible of low prices of sale to the consuming public, thereby making such malfunctioning nozzle detection apparatus economically available to the buying public.

Still yet another object of the present invention is to provide a new malfunctioning nozzle detection apparatus, which provides in the apparatuses and methods of the prior art some of the advantages thereof, while simultaneously overcoming some of the disadvantages normally associated therewith.

Still another object of the present invention is to provide a new malfunctioning nozzle detection apparatus for detecting malfunctioning inkjet nozzles of an inkjet printer eliminating the need for a human operator to identify the malfunctioning nozzles.

Yet another object of the present invention is to provide a new malfunctioning nozzle detection apparatus, which includes a testing media assembly that is adapted for coupling within the printer. The testing media assembly is adapted for having a carriage of the printer positioned over the testing media assembly such that the nozzles can print a test image on the testing media assembly. A scanning assembly is adapted for coupling within the printer proximate the testing media assembly. The scanning assembly is for optically scanning the test image printed on the testing media assembly. The scanning assembly is adapted for operationally coupling to a controller of the printer such that that the controller adjusts the print head when the scanning assembly detects imperfections in the test image.

Still yet another object of the present invention is to provide a new malfunctioning nozzle detection apparatus that would fulfill the need for a technique and apparatus for improving the quality of inkjet printer outputs, from consumer grade inkjet printers through large format commercial inkjet printers.

Even still another object of the present invention is to provide a new malfunctioning nozzle detection apparatus that would eliminate the need for a human operator to visually identify malfunctioning nozzles. It would also eliminate unnecessary waste of media occurring with existing techniques of accessing inkjets operability.

These together with other objects of the invention, along with the various features of novelty, which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
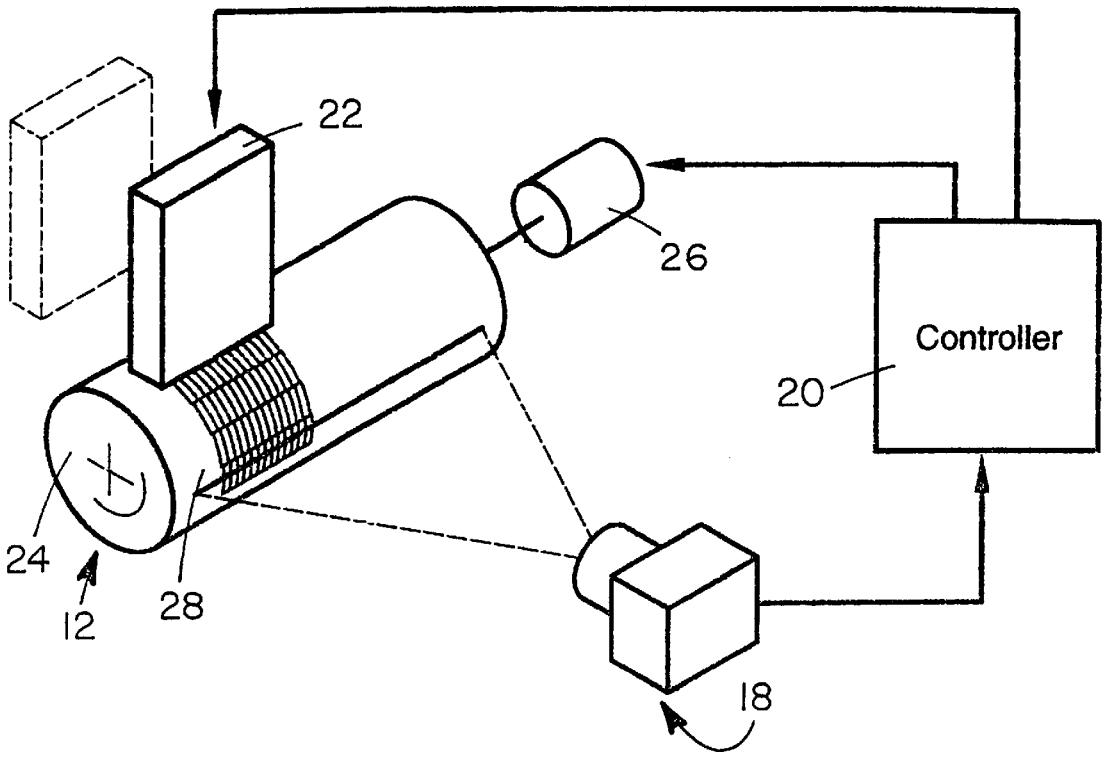
FIG. 1 is a block diagram view of a new malfunctioning nozzle detection apparatus according to the present invention.
Figure 2:
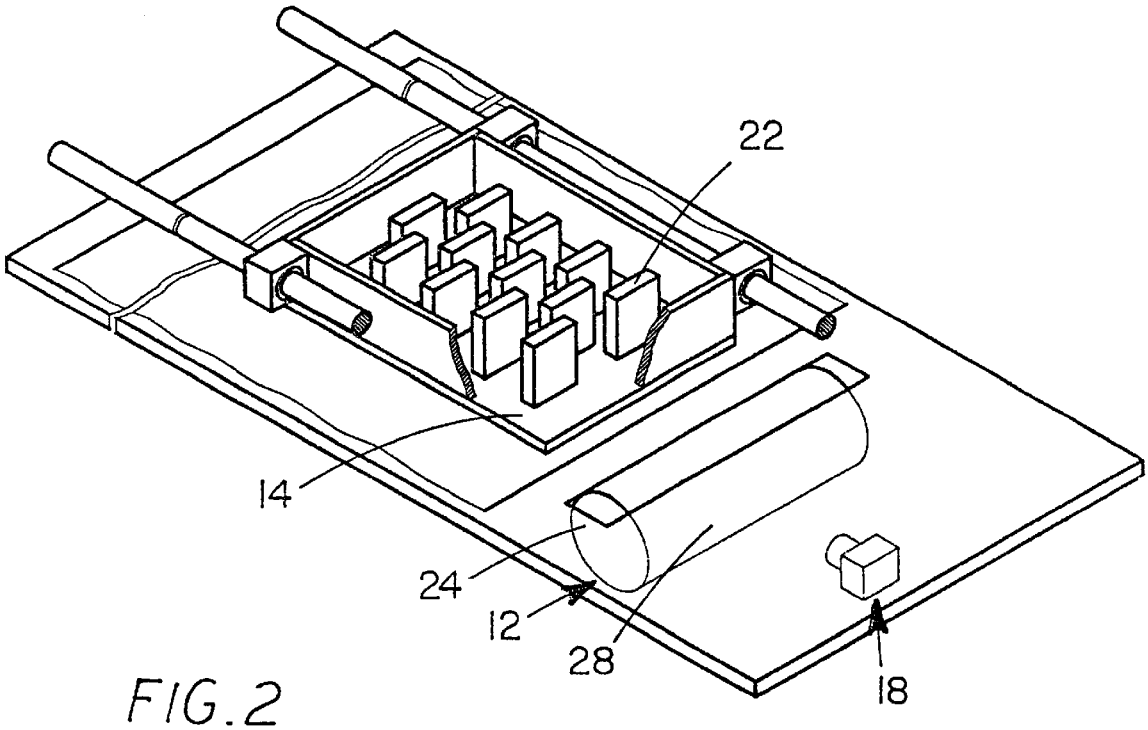
FIG. 2 is a perspective view of the present invention.
Figure 3:
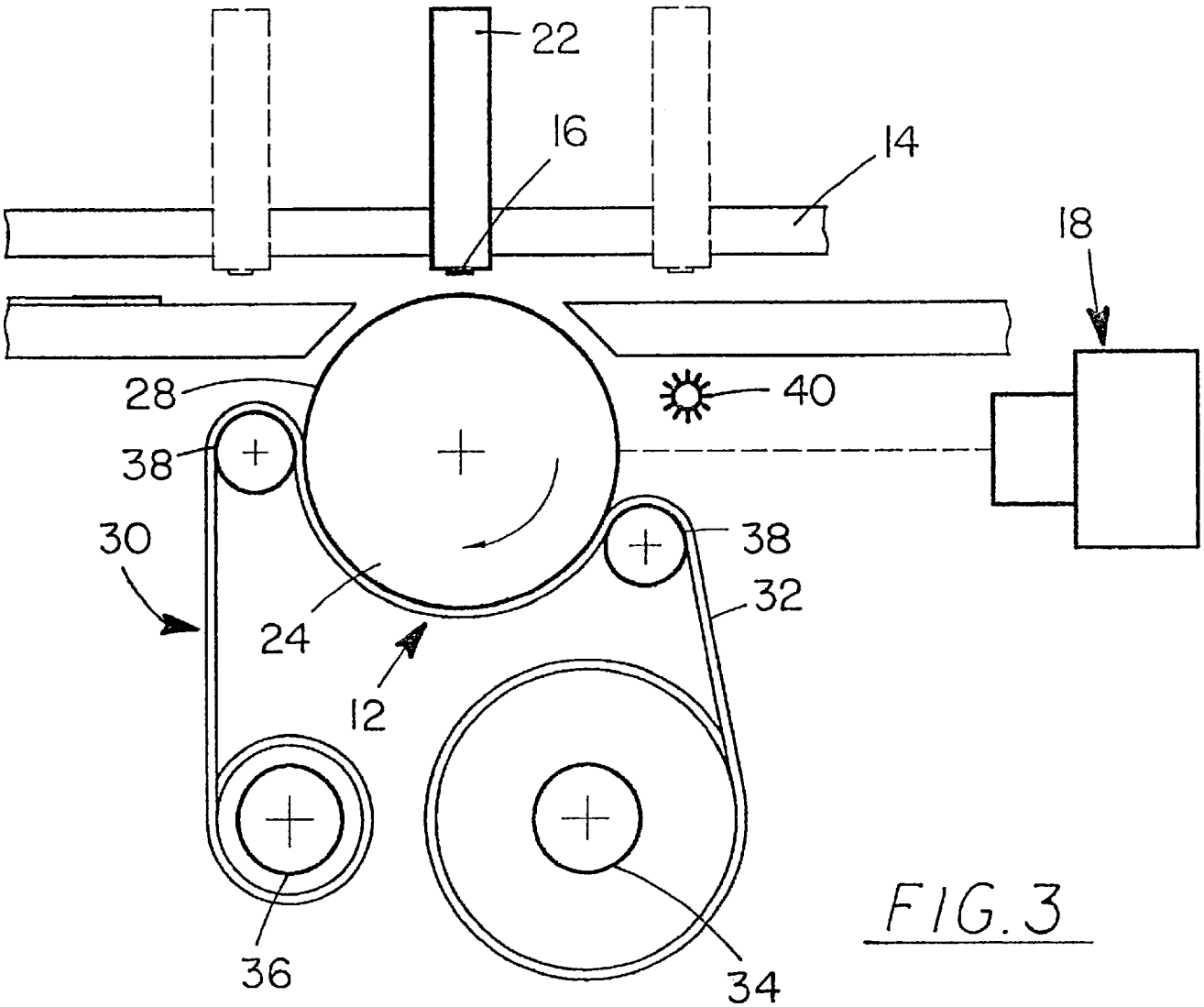
FIG. 3 is a perspective view of the present invention.
Figure 4:
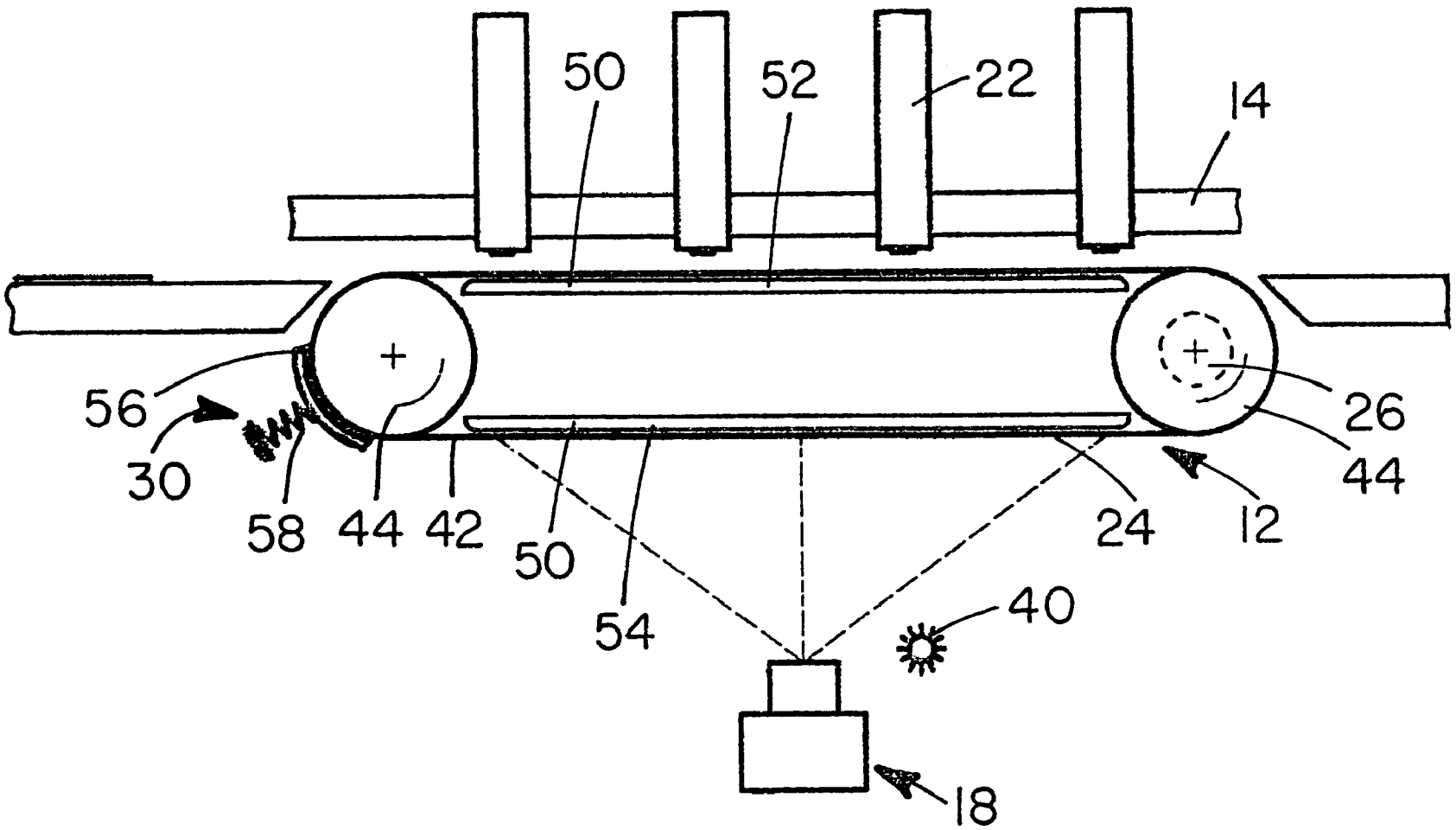
FIG. 4 is a perspective view of the present invention.
Figure 5:
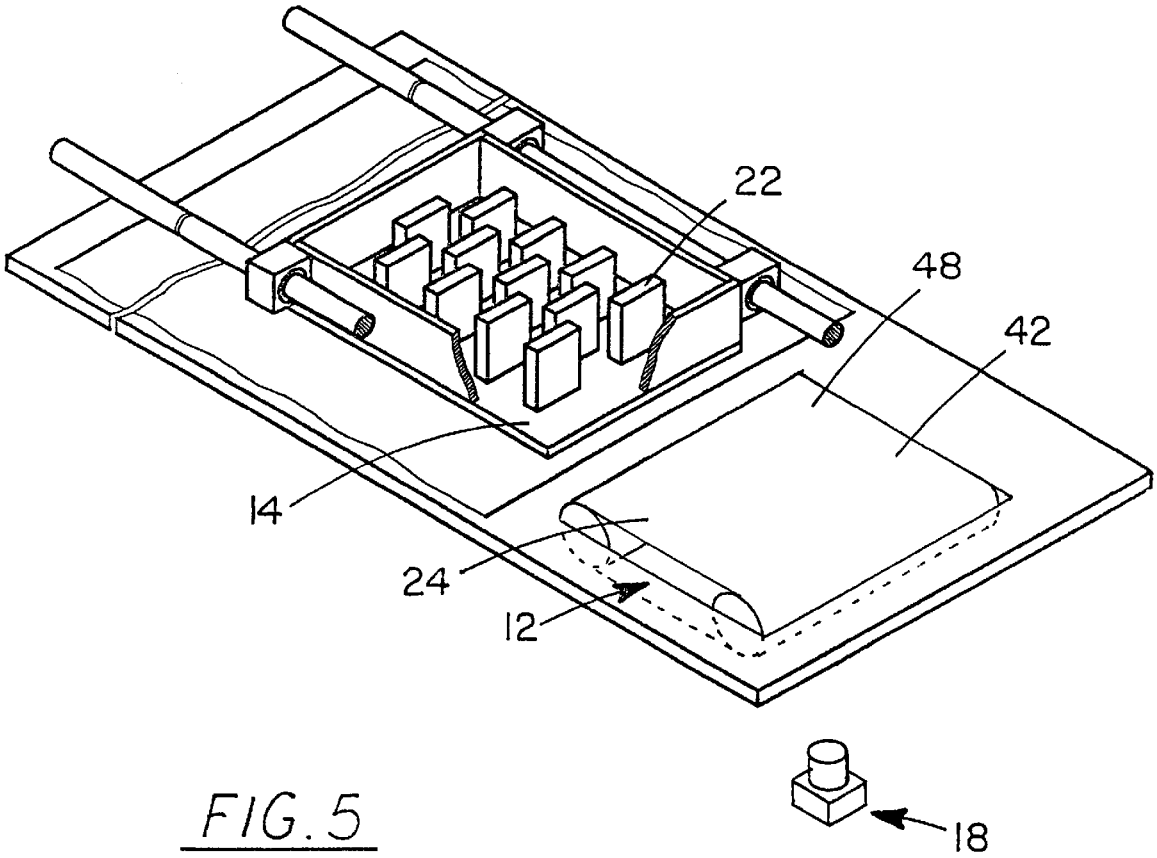
FIG. 5 is a perspective view of the present invention.

With reference now to the drawings, and in particular to FIGS. 1 through 5 thereof, a new malfunctioning nozzle detection apparatus embodying the principles and concepts of the present invention and generally designated by the reference numeral 10 will be described.

As best illustrated in FIGS. 1 through 5, the malfunctioning nozzle detection apparatus 10 generally includes a testing media assembly 12 that is adapted for coupling within the printer. The testing media assembly 12 is adapted for having a carriage 14 of the printer positioned over the testing media assembly 12 such that the nozzles 16 can print a test image on the testing media assembly 12. A scanning assembly 18 is adapted for coupling within the printer proximate the testing media assembly 12. The scanning assembly 18 is for optically scanning the test image printed on the testing media assembly 12. The scanning assembly 18 is adapted for operationally coupling to a controller 20 of the printer such that that the controller 20 adjusts the print head 22 when the scanning assembly 18 detects imperfections in the test image.

The testing media assembly 12 includes a drum 24 and a motor 26. The drum 24 has a printable surface 28 that is for receiving the test image from the nozzles 16 of the printing head 22. The motor 26 is for rotating the drum 24 such that the test image can be scanned by the scanning assembly 18.

An erasing assembly 30 has an erasing media 32. The erasing assembly 30 is positioned proximate the testing media assembly 12 such that the erasing media 32 contacts the printable surface 28 of the drum 24 of the testing media assembly 12. The erasing media 32 is for cleaning the test image from the printable surface 28 of the drum 24 after the test image has been scanned by the scanning assembly 18. The erasing assembly 30 has a supply roller 34 and a take up roller 36. The erasing media 32 is rolled from the supply roller 34 to the take up roller 36 such that the erasing media 32 is kept in contact with a lower portion of the drum 24 of the testing media assembly 12. The erasing assembly 30 has a pair of tension rollers 38. The erasing media 32 is rolled between the tension rollers 38 and the drum 24 of the testing media assembly 12 after is rolled off of the supply roller 34 such that the tension rollers 38 are for maintaining positive contact between the erasing media 32 and the drum 24 of the testing media assembly 12.

A light source 40 adapted for being coupled within the printer. The light source 40 is for illuminating the test image on the testing media assembly 12 when the test image is scanned by the scanning assembly 18.

In an embodiment the malfunctioning nozzle detection apparatus 10 has a testing media assembly 12 that has a belt 42 that is extended around a pair of belt rollers 44. The motor 26 is coupled to one of the belt rollers 44 such that the motor 26 is for rotating one of the belt rollers 44 for rotating the belt 42 under the printing head 22. The belt 42 has a printing surface 48 is for receiving the test image from one of the nozzles 16 of the printing head 22.

The testing media assembly 12 has a pair of alignment members 50. Each of the alignment members 50 are positioned the belt rollers 44 and an upper portion 52 and a lower portion 54 of the belt 42. One of the alignment members 50 is for keeping the upper portion 52 of the belt 42 flat when the test image is printed on the printing surface 48 of the belt 42. The other of the alignment members 50 is for keeping the lower portion 54 of the belt 42 flat when the test image is scanned by the scanning assembly 18.

An erasing assembly 30 has an erasing pad 56. The erasing assembly 30 is positioned adjacent to the belt 42 of the testing media assembly 12. The erasing pad 56 abutting the belt 42 of the testing media assembly 12 such that the erasing pad 56 erases the test image from the printing surface 48 of the belt 42 of the testing media assembly 12 when the belt 42 is passes by the erasing assembly 30. The erasing assembly 30 has a biasing member 58 coupled to the erasing pad 56. The biasing member 58 is adapted for coupling to the printer such that the biasing member 58 is for biasing the erasing pad 56 against the belt 42 of the testing media assembly 12.

In use, a the present invention would be comprised of an inkjet printing device having a plurality of print heads mounted on a carriage and performing scans across a medium. It would be equipped with a means of optically reading the pattern, which could be printed by the inkjet nozzles of the print heads on a separate medium and would be able to detect malfunctioning inkjet nozzles without marking the medium.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A malfunctioning nozzle detection apparatus for detecting a malfunctioning inkjet nozzle among a plurality of nozzles within a printing head in a printer, the malfunctioning nozzle detection apparatus comprising:

a testing media assembly being adapted for coupling within the printer, said testing media assembly being adapted for having a carriage of the printer positioned over said testing media assembly such that the nozzles can print a test image on said testing media assembly, said testing media assembly extending through a printing deck, said printing deck being positioned around said testing media assembly such that only a portion of said testing media assembly is exposed to the carriage of the printer, said printing deck being adapted for inhibiting environmental contamination of said test image when said test image is being printed; and a scanning assembly being adapted for coupling within the printer proximate said testing media assembly, said scanning assembly being for optically scanning said test image printed on said testing media assembly, said scanning assembly being adapted for operationally coupling to a controller of the printer such that the controller controls the print head to compensate for malfunctioning inkjet nozzles when said scanning assembly detects imperfections in said test image, said scanning assembly being positioned under said printing deck opposite the carriage of the printer such that said printing deck is adapted for inhibiting environmental contamination of said scanning assembly when said scanning assembly is scanning said test image.

2. The malfunctioning nozzle detection apparatus as set forth in claim 1, wherein said testing media assembly comprises a drum and a motor, said drum having a printable surface being for receiving said test image from the nozzles of the printing head, said motor being for rotating said drum such that said test image is scanned by said scanning assembly.

3. The malfunctioning nozzle detection apparatus as set forth in claim 2, further comprising:

an erasing assembly having an erasing media, said erasing assembly being positioned proximate said testing media assembly such that said erasing media contacts said printable surface of said drum of said testing media assembly, said erasing media being for cleaning said test image from said printable surface of said drum after said test image has been scanned by said scanning assembly.

4. The malfunctioning nozzle detection apparatus as set forth in claim 3, wherein said erasing assembly has a supply roller and a take up roller, said erasing media being rolled from said supply roller to said take up roller such that said erasing media is kept in contact with a lower portion of said drum of said testing media assembly.

5. The malfunctioning nozzle detection apparatus as set forth in claim 4, wherein said erasing assembly has a pair of tension rollers, said erasing media being rolled between said tension rollers and said drum of said testing media assembly after being rolled off of said supply roller such that said tension rollers are for maintaining positive contact between said erasing media and said drum of said testing media assembly.

6. The malfunctioning nozzle detection apparatus as set forth in claim 1, wherein testing media assembly has a belt being extended around a pair of belt rollers, said motor being coupled to one of said belt rollers such that said motor is for rotating one of said belt rollers for rotating said belt under the printing head, said belt having a printing surface being for receiving said test image from the nozzles of the printing head.

7. The malfunctioning nozzle detection apparatus as set forth in claim 6, wherein said testing media assembly has a pair of alignment members, each of said alignment members being positioned between said belt rollers and an upper portion and a lower portion of said belt, one of said alignment members being for keeping said upper portion of said belt flat when said test image is being printed on said printing surface of said belt, the other of said alignment members being for keeping said lower portion of said belt flat when said test image is being scanned by said scanning assembly.

8. The malfunctioning nozzle detection apparatus as set forth in claim 6, further comprising:

an erasing assembly having an erasing pad, said erasing assembly being positioned adjacent to said belt of said testing media assembly, said erasing pad abutting said belt of said testing media assembly such that said erasing pad erases said test image from said printing surface of said belt of said testing media assembly when said belt is passes by said erasing assembly.

9. The malfunctioning nozzle detection apparatus as set forth in claim 8, wherein said erasing assembly has a biasing member coupled to said erasing pad, said biasing member being adapted for coupling to the printer such that said biasing member is for biasing said erasing pad against said belt of said testing media assembly.

10. The malfunctioning nozzle detection apparatus as set forth in claim 1, further comprising:

a light source adapted for being coupled within the printer, said light source being for illuminating said test image on said testing media assembly when said test image is being scanned by said scanning assembly.

11. A malfunctioning nozzle detection apparatus for detecting a malfunctioning inkjet nozzle among a plurality of nozzles within a printing head in a printer, the malfunctioning nozzle detection apparatus comprising:

a testing media assembly being adapted for coupling within the printer, said testing media assembly being adapted for having a carriage of the printer positioned over said testing media assembly such that the nozzles can print a test image on said testing media assembly, said testing media assembly extending through a printing deck, said print ing deck being positioned around said testing media assembly such that only a portion of said testing media assembly is exposed to the carriage of the printer, said printing deck being adapted for inhibiting environmental contamination of said test image when said test image is being printed;

a scanning assembly being adapted for coupling within the printer proximate said testing media assembly, said scanning assembly being for optically scanning said test image printed on said testing media assembly, said scanning assembly being adapted for operationally coupling to a controller of the printer such that the controller controls the print head to compensate for malfunctioning inkjet nozzles when said scanning assembly detects imperfections in said test image, said scanning assembly being positioned under said printing deck opposite the carriage of the printer such that said printing deck is adapted for inhibiting environmental contamination of said scanning assembly when said scanning assembly is scanning said test image;

wherein said testing media assembly comprises a drum and a motor, said drum having a printable surface being for receiving said test image from the nozzles of the printing head, said motor being for rotating said drum such that said test image is scanned by said scanning assembly;

wherein an erasing assembly having an erasing media, said erasing assembly being positioned proximate said testing media assembly such that said erasing media contacts said printable surface of said drum of said testing media assembly, said erasing media being for cleaning said test image from said printable surface of said drum after said test image has been scanned by said scanning assembly;

wherein said erasing assembly has a supply roller and a take up roller, said erasing media being rolled from said supply roller to said take up roller such that said erasing media is kept in contact with a lower portion of said drum of said testing media assembly;

wherein said erasing assembly has a pair of tension rollers, said erasing media being rolled between said tension rollers and said drum of said testing media assembly after being rolled off of said supply roller such that said tension rollers are for maintaining positive contact between said erasing media and said drum of said testing media assembly; and a light source adapted for being coupled within the printer, said light source being for illuminating said test image on said testing media assembly when said test image is being scanned by said scanning assembly.

* * * * *